US008825414B2

(12) United States Patent
Garvey et al.

(10) Patent No.: US 8,825,414 B2
(45) Date of Patent: Sep. 2, 2014

(54) SYSTEM AND METHOD FOR ESTIMATING REMAINING USEFUL LIFE OF A DOWNHOLE TOOL

(75) Inventors: Dustin R. Garvey, Houston, TX (US); Joerg Baumann, Soltau (DE); Joerg Lehr, Lower Saxony (DE); Martin John, Saxony (DE); Olof Hummes, Northrhine-Westfalia (DE)

(73) Assignee: Baker Hughes Incorporated, Houston, TX (US)

( * ) Notice: Subject to any disclaimer, the term of this patent is extended or adjusted under 35 U.S.C. 154(b) by 338 days.

(21) Appl. No.: 13/180,959

(22) Filed: Jul. 12, 2011

(65) Prior Publication Data

US 2012/0089336 A1 Apr. 12, 2012

Related U.S. Application Data

(60) Provisional application No. 61/364,062, filed on Jul. 14, 2010.

(51) Int. Cl.
*G06F 19/00* (2011.01)

(52) U.S. Cl.
USPC ..... 702/34; 702/6; 702/9; 702/176; 702/179

(58) Field of Classification Search
USPC ..... 702/6, 9, 34, 176, 179
See application file for complete search history.

(56) References Cited

U.S. PATENT DOCUMENTS

| | | | | |
|---|---|---|---|---|
| 3,752,966 | A * | 8/1973 | Foy et al. | 702/9 |
| 6,206,108 | B1 | 3/2001 | MacDonald et al. | |
| 6,411,908 | B1 * | 6/2002 | Talbott | 702/34 |
| 7,299,162 | B2 * | 11/2007 | Loecher et al. | 703/2 |
| 8,109,150 | B2 * | 2/2012 | Sato et al. | 73/799 |
| 2002/0130783 | A1 | 9/2002 | Hogan | |
| 2005/0197813 | A1 * | 9/2005 | Grayson | 703/10 |
| 2008/0183404 | A1 * | 7/2008 | Emami et al. | 702/34 |
| 2009/0194332 | A1 | 8/2009 | Pastusek et al. | |
| 2010/0153023 | A1 * | 6/2010 | Parham et al. | 702/34 |

FOREIGN PATENT DOCUMENTS

| | | | | |
|---|---|---|---|---|
| JP | 09195795 A | * | 7/1997 | F02C 7/00 |
| JP | 10160646 A | * | 6/1998 | G01M 19/00 |

OTHER PUBLICATIONS

Garvey, D. R., et al.; "Pattern Recognition Based Remaining Useful Life Estimation of Bottom Hole Assembly Tools"; SPE/IADC Drilling Conference and Exhibition; p. 1-8; Mar. 17-19, 2009.
International Search Report and Written Opinion dated Oct. 19, 2011 for Application No. PCT/US2011/044030.

* cited by examiner

*Primary Examiner* — Mohamed Charioui
*Assistant Examiner* — John Kuan
(74) *Attorney, Agent, or Firm* — Cantor Colburn LLP

(57) ABSTRACT

A system for determining the amount of life consumed for a tool includes at least one sensor associated with the tool for generating observation data, a memory in operable communication with the at least one sensor, the memory including a database for storing the observation data generated by the sensor, and a processor in operable communication with the memory. The processor includes a model generator that generates a current model for a current run of the tool. The current model includes parameters of a functional approximation of the observation data. The processor also includes a classifier that classifies the current model and a current run estimator that determine the amount of life consumed based on the classification of the current model and a time of use associated with the current run.

8 Claims, 4 Drawing Sheets

SYSTEM AND METHOD FOR ESTIMATING REMAINING USEFUL LIFE OF A DOWNHOLE TOOL

BACKGROUND OF THE INVENTION

Various tools are used in hydrocarbon exploration and production to measure properties of geologic formations during or shortly after the excavation of a borehole. The properties are measured by formation evaluation (FE) tools and other suitable devices, which are typically integrated into a bottomhole assembly. Sensors are used in the FE tools to monitor various downhole conditions and formation characteristics.

Environments in which FE tools, drilling equipment and other drillstring components operate are very severe, and include conditions such as high downhole temperatures (e.g., in excess of 200° C.) and high impact vibration events. Furthermore, rig operators are currently using the tools to perform mission profiles that have previously been impossible, thereby increasing the stress on the tools. Simultaneously, customers are demanding high reliability to help them prevent costly downhole failures.

To date, periodic maintenance has been the most widely spread method by which tool reliability is maintained. As time progresses, there has been a shift toward condition based maintenance, which, as of today, uses design guidelines and rough thresholds for nominal operation to assess individual tool health. Present techniques, however, are inferior in that a large amount of telemetry data collected during operation that has yet to be effectively harnessed.

BRIEF DESCRIPTION OF THE INVENTION

Disclosed is a system for determining the amount of life consumed for a tool includes at least one sensor associated with the tool for generating observation data and a memory in operable communication with the at least one sensor and including a database for storing the observation data generated by the sensor. The system also includes a processor in operable communication with the memory. The processor includes a model generator that generates a current model for a current run of the tool, the current model including parameters of a functional approximation of the observation data. The processor also includes a classifier that classifies the current model and a current run estimator that determines the amount of life consumed based on the classification of the current model and a time of use associated with the current run.

Also disclosed is a method of estimating the remaining life of a tool used in forming a borehole penetrating the earth. The method includes forming functional approximations of runs of multiple example tools that include a failure time; storing the parameters of the functional approximations for each example tool and the failure times as a vector of models; forming current parameters of a functional approximation of a current run of the tool; storing the current parameters and a time of use for the current run; comparing the current parameters to the parameters to select the parameters that most closely match the current parameters; and comparing the failure time associated with the selected parameters to the time of use of the current run to determine the amount of life used by the current run.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

Embodiments of the present invention are directed to systems and methods for assessing the remaining useful life of a downhole tool or other mechanism. The systems and methods compare the amount of time a tool is exposed to certain stressors to determine how much of the useful life has been consumed by the exposure. Each time the tool is exposed to stressors, the process is repeated to keep a running total of the amount of life consumed. The running total is simply the aggregation of the amount of life consumed by each exposure in one embodiment.

Figure 1:
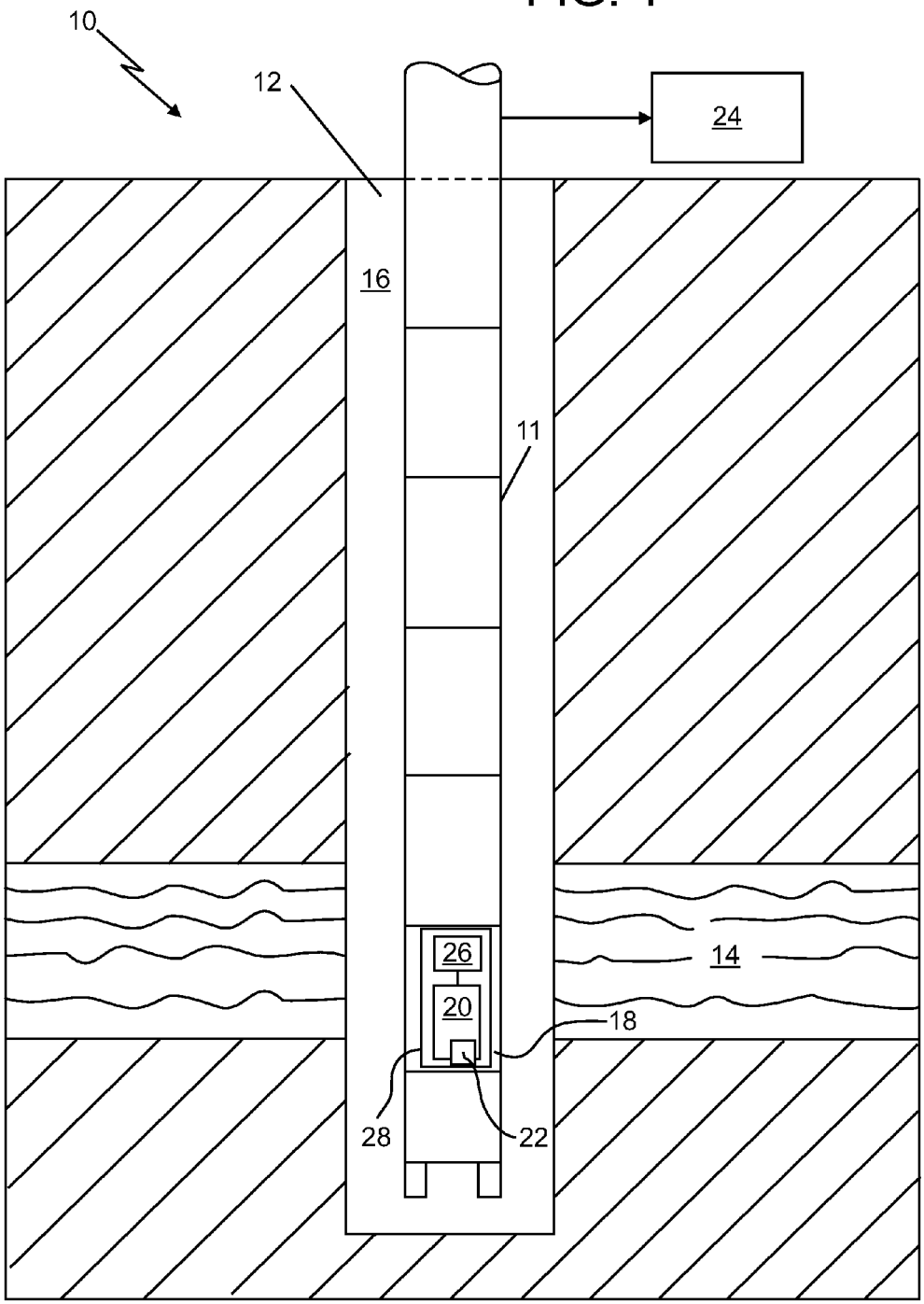
FIG. 1 depicts an embodiment of a well logging system.

Referring to FIG. 1, an exemplary embodiment of a well logging system 10 includes a drillstring 11 that is shown disposed in a borehole 12 that penetrates at least one earth formation 14 for making measurements of properties of the formation 14 and/or the borehole 12 downhole. Drilling fluid, or drilling mud 16 may be pumped through the borehole 12. As described herein, "formations" refer to the various features and materials that may be encountered in a subsurface environment. Accordingly, it should be considered that while the term "formation" generally refers to geologic formations of interest, that the term "formations," as used herein, may, in some instances, include any geologic points or volumes of interest (such as a survey area). In addition, it should be noted that "drillstring" as used herein, refers to any structure suitable for lowering a tool through a borehole or connecting a drill to the surface, and is not limited to the structure and configuration described herein.

In one embodiment, a bore hole assembly (BHA) 18 is disposed in the well logging system 10 at or near the downhole portion of the drillstring 11. The BHA 18 includes any number of downhole formation evaluation (FE) tools 20 for measuring versus depth and/or time one or more physical quantities in or around a borehole. The taking of these measurements is referred to as "logging", and a record of such measurements is referred to as a "log". Many types of measurements are made to obtain information about the geologic formations. Some examples of the measurements include gamma ray logs, nuclear magnetic resonance logs, neutron logs, resistivity logs, and sonic or acoustic logs.

Examples of logging processes that can be performed by the system 10 include measurement-while-drilling (MWD) and logging-while-drilling (LWD) processes, during which measurements of properties of the formations and/or the borehole 12 are taken downhole during or shortly after drilling. The data retrieved during these processes may be transmitted to the surface, and may also be stored with the downhole tool for later retrieval. Other examples include logging measurements after drilling, wireline logging, and drop shot logging.

The downhole tool 20, in one embodiment, includes one or more sensors or receivers 22 to measure various properties of the formation 14 as the tool 20 is lowered down the borehole 12. Such sensors 22 include, for example, nuclear magnetic resonance (NMR) sensors, resistivity sensors, porosity sensors, gamma ray sensors, seismic receivers and others.

Each of the sensors 22 may be a single sensor or multiple sensors located at a single location. In one embodiment, one or more of the sensors includes multiple sensors located proximate to one another and assigned a specific location on the drillstring 11. Furthermore, in other embodiments, each sensor 22 includes additional components, such as clocks, memory processors, etc.

In one embodiment, the tool 20 is equipped with transmission equipment to communicate ultimately to a surface processing unit 24. Such transmission equipment may take any desired form, and different transmission media and methods may be used. Examples of connections include wired, fiber optic, wireless connections or mud pulse telemetry.

In one embodiment, the surface processing unit 24 and/or the tool 20 include components as necessary to provide for storing and/or processing data collected from the tool 20. Exemplary components include, without limitation, at least one processor, storage, memory, input devices, output devices and the like. The surface processing unit 24 optionally is configured to control the tool 20.

In one embodiment, the tool 20 also includes a downhole clock 26 or other time measurement device for indicating a time at which each measurement was taken by the sensor 20. The sensor 20 and the downhole clock 26 may be included in a common housing 28. With respect to the teachings herein, the housing 28 may represent any structure used to support at least one of the sensor 20, the downhole clock 26, and other components.

Figure 2:
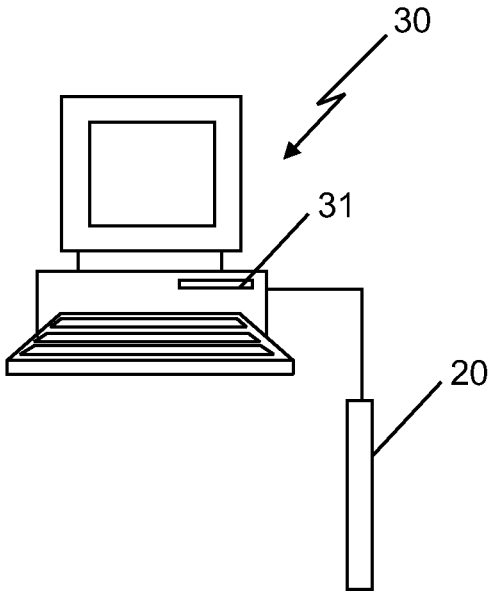
FIG. 2 depicts an embodiment of a system for determining the consumed life of a downhole tool.

Referring to FIG. 2, there is provided a system 30 for assessing the health of the downhole tool 20, or other device used in conjunction with the BHA 18 and/or the drillstring 11. The system 30 may be incorporated in a computer or other processing unit capable of receiving data from the tool 20. The processing unit may be included with the tool 20 or included as part of the surface processing unit 24.

In one embodiment, the system 30 includes a computer 31 coupled to the tool 20. Exemplary components include, without limitation, at least one processor, storage, memory, input devices, output devices and the like. As these components are known to those skilled in the art, these are not depicted in any detail herein. The computer 31 may be disposed in at least one of the surface processing unit 24 and the tool 20.

Generally, some of the teachings herein are reduced to an algorithm that is stored on machine-readable media. The algorithm is implemented by the computer 31 and provides operators with desired output.

The tool 20 generates measurement data, which is stored in a memory associated with the tool 20 and/or the surface processing unit 24. The computer 31 receives data from the tool 20 and/or the surface processing unit 24 for determination of an amount of life of the tool 20 that has been consumed. In one embodiment, the data includes any type of data relating to measured characteristics of the formation 14 and/or borehole 12, as well as data relating to the operation of the tool 20. In one example, the data includes pressure, electric current, motor RPM, drill rotation rate, vibration and temperature measurements.

Although the computer 31 of FIG. 2 is described herein as separate from the tool 20 and the surface processing unit 24 of FIG. 1, the computer 31 may be a component of either the tool 20 or the surface processing unit 24, and accordingly either the tool 20 or the surface processing unit 24 may serve as an apparatus for the remaining life of a tool 20.

Figure 3:
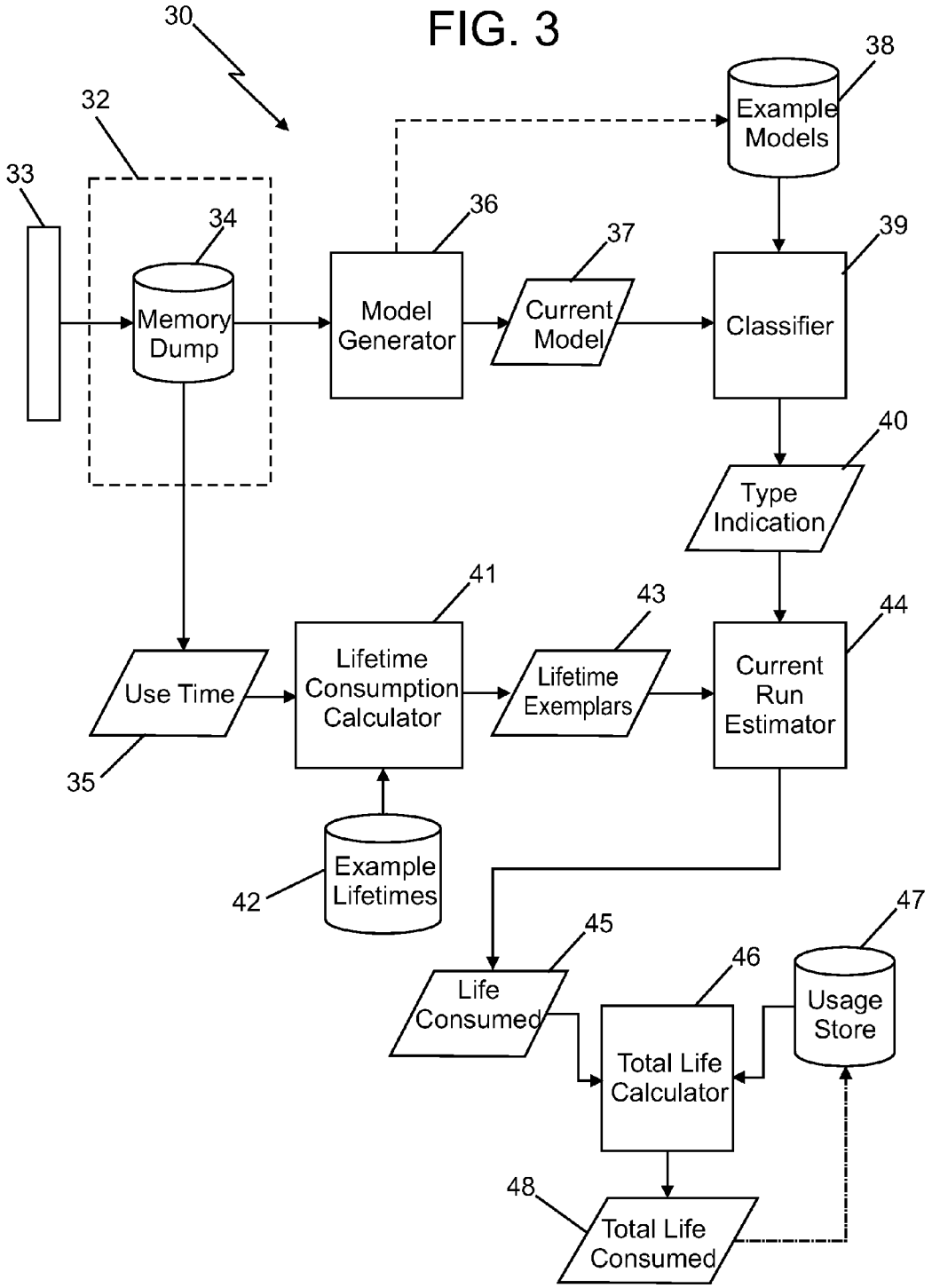
FIG. 3 depicts a dataflow diagram for a system according to one embodiment.

Referring to FIG. 3, a dataflow diagram for a system 30 according to one embodiment is shown. The system 30 of this embodiment includes a memory 32 in which information from a tool 33 is stored. The memory 32 may be formed in a single device or may be distributed over multiple devices.

In the illustrated embodiment, the memory 32 includes a memory dump database 34. The memory dump database 34 includes memory dump data. The memory dump data in the memory dump database 34 may include, for example, sensor readings related to sensed physical quantities in and/or around the borehole 12, such as temperature, pressure and vibration. In one embodiment, each tool 33 in a fleet has memory dump data associated with it.

In one embodiment, the memory dump database 34 may include an amount of time 35 that a particular tool 33 has been exposed to particular conditions. For example, the tool 33 may have just performed a particular run for a particular amount of time 35 and this time is associated with the memory dump data stored in the memory dump database 34. In one embodiment, each run of the tool 33 may include a separate record.

The system 30 illustrated in FIG. 3 also includes a model generator 36. The model generator 36 generates a current model 37 from the memory dump data for a particular run of a particular tool 33 in the memory dump database 34. For example, a tool 33 may be utilized in a run the current model 37 is formed based on the conditions experienced by the tool 33 in that run. The current model 37 is formed as described below.

The model generator 36 may also be utilized to create example models 38. The example models 38 represent the accumulated stresses on other tools from first use till failure or till a predefined threshold. The example models 38 are used as comparisons for the current model 37.

The example models 38 may be formed in many different fashions. One example is disclosed in U.S. patent application Ser. No. 12/428,654, filed Apr. 23, 2009, entitled SYSTEM AND METHOD FOR HEALTH ASSESSMENT OF DOWNHOLE TOOLS, and which is hereby incorporated by reference in its entirety. In general, the example models 38 are based off of stress histories for different tools from birth (e.g., first run or first run after maintenance) to failure.

Figure 4:
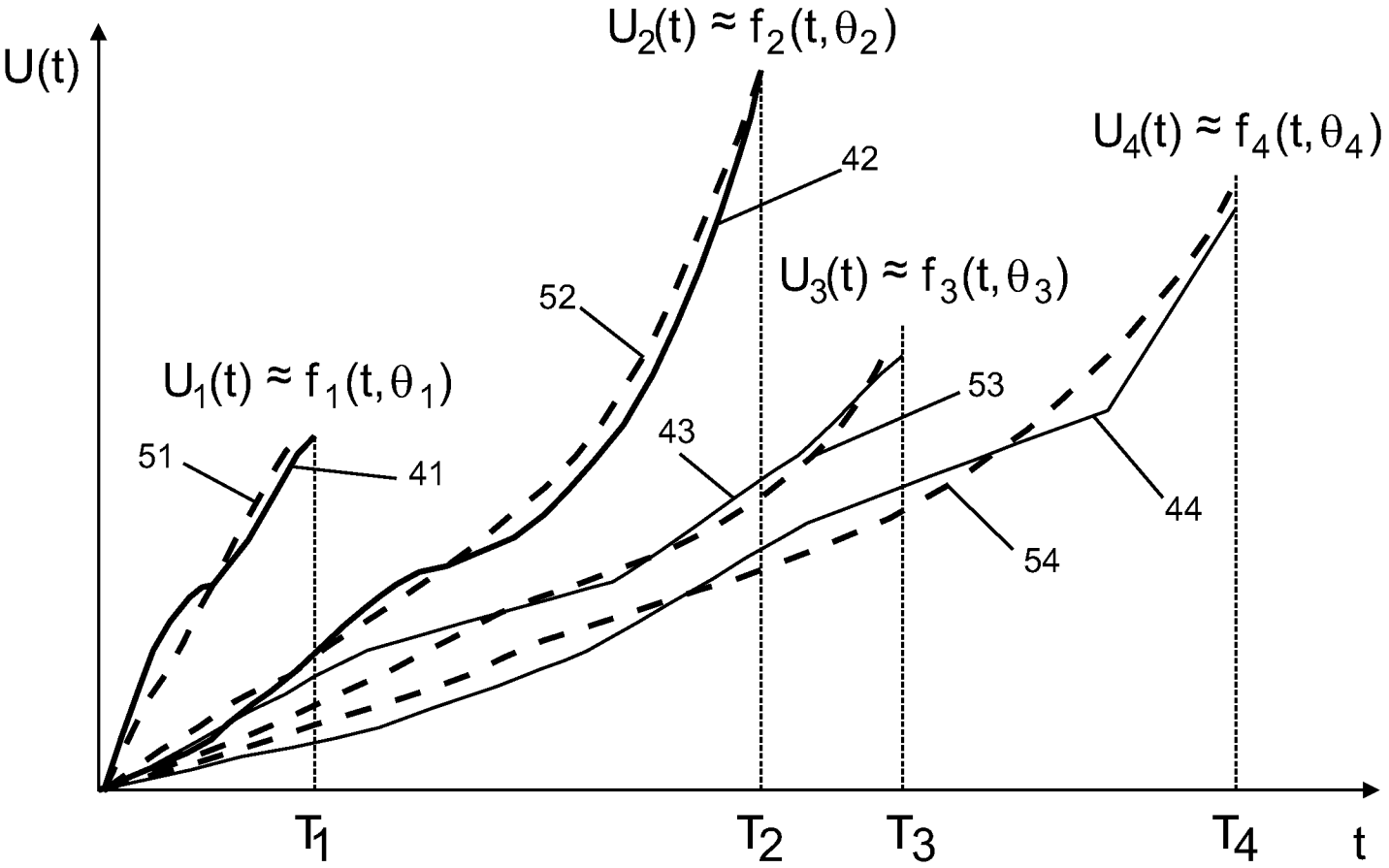
FIG. 4 illustrates a plurality of degradation paths and models created therefrom.

Referring to FIG. 4, exemplar degradation signals (stress histories) 41, 42, 43, and 44 are shown, represented as "$U_i(t)$", and their failure time shown as $T_1$, $T_2$, $T_3$ and $T_4$. In one embodiment, example models signals 51, 52, 53 and 54 are formed by fitting an arbitrary function, referred to as "$f_i(t,\theta_i)$", to the stress histories 41, 42, 43 and 44, respectively, via regression, machine learning, or other fitting techniques.

In the above referenced application, two pieces of information are extracted from the degradation paths, specifically the failure times and the "shape" of the degradation that is described by the functional approximations $f_i(t,\theta_i)$.

These pieces of information can be used to construct a vector of exemplar failure time and functional approximations, as follows:

$$U(t) = \begin{bmatrix} f_1(t, \theta_1) \\ f_2(t, \theta_2) \\ f_3(t, \theta_3) \\ f_4(t, \theta_4) \end{bmatrix} \quad T = \begin{bmatrix} T_1 \\ T_2 \\ T_3 \\ T_4 \end{bmatrix}$$

where T and $f_i(t,\theta i)$ are the failure times and functional approximation of the $i^{th}$ exemplar degradation signal path and $\theta i$ are the parameters of the $i^{th}$ functional approximation of the $i^{th}$ exemplar degradation signal path.

In the above referenced patent application, a remaining useful life of the tool 33 was estimated by implementing a three step process: 1) estimate the expected accumulated stresses and remaining lifetimes, 2) classify the current stress path according to its current accumulated stress, and 3) estimate the remaining useful life by combining the classification results with the expected remaining lifetimes.

In some instances it may be difficult to construct a complete stress history for a tool 33 in order to estimate the remaining life of the tool 33. Accordingly, embodiments disclosed herein do not attempt to determine the useful life remaining. Rather, embodiments herein attempt to determine how much of the useful life is consumed by a particular run and then sum all runs to determine the total useful consumed over all runs.

Referring back to FIG. 3, the model generator 36 creates a current model 37 for the current tool run. In one embodiment, and contrary to the prior art, instead of storing the functional approximations ($f_i(t,\theta i)$), the current model 37 (and the example models 38) includes the parameters of the functional approximations ($\theta$) and the failure time $T_i$ as shown below:

$$\Theta = \begin{bmatrix} \theta_1 \\ \theta_2 \\ \theta_3 \\ \theta_4 \end{bmatrix} \quad T = \begin{bmatrix} T_1 \\ T_2 \\ T_3 \\ T_4 \end{bmatrix}$$

In one embodiment, the example models 38 include the vector $\theta$ for each example tool 33. The vector $\theta$ for the current run (by means of current model 37) is provided to a classifier 39. The classifier 39 compares the current model 37 to the example models 38 to create a type indication 40. It shall be understood that the example models 38 include a vector $\theta$ for each tool in its dataset.

The type indication 40 identifies which of the example models 38 the current model 37 most closely resembles. The type indication 40 may be determined by known means. For example, Euclidean distance calculations could be utilized.

As discussed above, the memory dump database may include a use time 35 for each run. The use time 35 is provided to a life consumption calculator 41. The life consumption calculator 41 is coupled to example lifetimes 42. The example lifetimes 42 contain the failure times (vector T above) for each of the tools in the example models 38. That is, for each tool in the example models 38, a failure time T is stored in the example lifetimes 42.

Based the use time 35 and the example lifetimes 42, the life consumption calculator 41 determines how much of each of the possible lifetimes the current run has utilized and outputs the results as lifetime exemplars 43. For example, given four tools having four failure times $T_1$, $T_2$, $T_3$ and $T_4$, the lifetime exemplars may be represented as (Use time)/$T_i$ for each tool.

A current run estimator receives the type indication 40 and the lifetime exemplars 43. Based on the type indication 40, the current run estimator 44 selects one of the lifetime exemplars 43. The selected lifetime exemplar 43 is shown as life consumed 45 in FIG. 3. The life consumed 45 represents how much of the life the tool 33 the current run utilized.

To summarize, for a particular run, the functional parameters of the run are determined by the model generator 36 and compared to other models by the classifier 39. The classifier 39 determines which of the models the particular run most closely resembles. The length of the particular run is divided by the failure time of the model the particular run resembles. This determines how much of the useful life of a tool 33 a particular run has used.

The system 30 may also include optional components 46 and 47. In more detail, the system 30 may include a total lifetime calculator 46. The total lifetime calculator 46 adds the life consumed 45 on the current run to a running total of life used stored in a usage store 47. The sum of these values is the total amount of life consumed 48 for the tool 33. This value may be stored in usage store 47 to ensure that the usage store 47 includes the most current usage for each tool 33.

Figure 5:
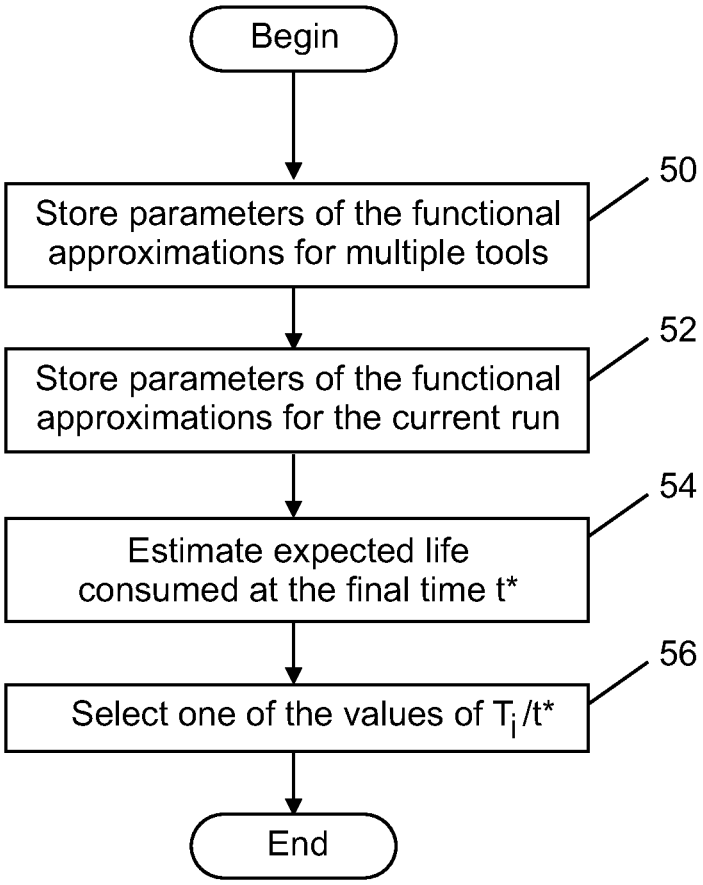
FIG. 5 shows a method according to one embodiment.

FIG. 5 illustrates a method according to one embodiment. This example assumes that for a particular run of interest (the current run), the accumulated stress may be represented by $\{u(t_1), u(t_2), u(t_3), \ldots, u(t^*)\}$.

At a block 50, the parameters of the functional approximations for multiple tools are stored. These values may be determined as described above. In short, for each of the models the system 30 (FIG. 3) may store parameters of the functional approximations and the failure times as indicated in the following equations:

$$\Theta = \begin{bmatrix} \theta_1 \\ \theta_2 \\ \theta_3 \\ \theta_4 \end{bmatrix} \quad T = \begin{bmatrix} T_1 \\ T_2 \\ T_3 \\ T_4 \end{bmatrix}$$

At a block 52, the parameters of the functional approximations for the current run are stored. For example, the "shape" of the plot of the current run may be determined using know techniques. This leads to the creation of vector $\theta'$.

At a block 54 the expected life consumed at the final time $t^*$ is estimated. As The estimation may be represented as:

$$L_c = \frac{1}{t^*} T = \begin{bmatrix} T_1/t^* \\ T_2/t^* \\ T_3/t^* \\ T_4/t^* \end{bmatrix}$$

where $L_c$ is the lifetime consumed. In one embodiment, the $L_c$ represents the lifetime exemplars 43 of FIG. 3.

At a block 56, one of the values $T_i/t^*$ is selected based on which of the values in vector $\theta$ is most similar to $\theta'$. The selected value equals the amount of useful life utilized for the tool in the particular run.

In one embodiment, any of an infinite number of combinations of approximating functions and mapping algorithms could be used in blocks 50, 52 and 56. For example, linear regression may be used to parameterize accumulated stress paths, the slopes of the paths may be used as the function parameters, and a Neuro-Fuzzy Inference System may be used to map the estimated slope to the consumed life 45.

One advantage of this approach is that consumed life may be aggregated without requiring the entire usage path for a tool. For example, if a tool is on m occasions and, thus, three estimates of the consumed life have been created, the total consumed life can be easily calculated merely by adding the consumed life for each run.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing aspects of the teachings herein. For example, a sample line, sample storage, sample chamber, sample exhaust, pump, piston, power supply (e.g., at least one of a generator, a remote supply and a battery), vacuum supply, pressure supply, refrigeration (i.e., cooling) unit or supply, heating component, motive force (such as a translational force, propulsional force or a rotational force), magnet, electromagnet, sensor, electrode, transmitter, receiver, transceiver, controller, optical unit, electrical unit or electromechanical unit may be included in support of the various aspects discussed herein or in support of other functions beyond this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A system for determining an amount of life consumed for a tool, the system comprising:

at least one sensor associated with the tool for generating observation data;

a memory in operable communication with the at least one sensor, the memory including a database for storing the observation data generated by the at least one sensor; and a processor in operable communication with the memory, the processor including:

a model generator that generates a current model having a failure time for a current run of the tool, the current model including parameters of a functional approximation of the observation data;

a classifier that classifies the current model;

a current run estimator that determines the amount of life consumed based on the classification of the current model and a time of use associated with the current run by dividing the time of use by the failure time of the current model; and a total lifetime calculator that adds the amount of life consumed by the current run to a running total of life consumed by prior runs of the tool to produce a total life consumed.

2. The system of claim 1, wherein the observation data include an amount of time the tool was exposed to a particular condition.

3. The system of claim 2, wherein the particular condition is experienced in a borehole penetrating the earth.

4. The system of claim 1, wherein the functional approximation of the observation data is a function that defines a degradation curve of the current run and is based on the parameters.

5. The system of claim 4, wherein the current model includes an amount of time the tool was operated.

6. The system of claim 1, further comprising:

a usage store that stores the running total of life consumed.

7. The system of claim 1, wherein the tool is a drilling tool.

8. The system of claim 1, wherein the sensor is part of a bottom hole assembly.

* * * * *